US005411410A

United States Patent [19]

Ogawa et al.

[11] Patent Number: 5,411,410

[45] Date of Patent: May 2, 1995

[54] TERMINAL

[75] Inventors: Shinji Ogawa, Yokkaichi; Masayoshi Matsumoto, Isehara, both of Japan

[73] Assignees: Sumitomo Wiring Systems, Ltd., Yokkaichi; Ichikoh Industries, Ltd., Tokyo, both of Japan

[21] Appl. No.: 128,150

[22] Filed: Sep. 29, 1993

[30] Foreign Application Priority Data

Oct. 23, 1992 [JP] Japan ..... 4-074180 U

[51] Int. Cl.[6] ..... H01R 4/50

[52] U.S. Cl. ..... 439/336; 439/619

[58] Field of Search ..... 439/335, 336, 356, 611, 439/613, 617–619, 862

[56] References Cited

U.S. PATENT DOCUMENTS

| | | | |
|---|---|---|---|
| 3,417,362 | 12/1968 | Reynolds . | |
| 3,986,068 | 10/1976 | Albrecht | 439/619 X |
| 4,647,132 | 3/1987 | Mikola | 439/611 X |
| 4,720,272 | 1/1988 | Durand | 439/619 X |
| 5,282,756 | 2/1994 | Heindl et al. | 439/613 X |

FOREIGN PATENT DOCUMENTS

| | | |
|---|---|---|
| 1417351 | 10/1965 | France . |
| 2615040 | 10/1977 | Germany . |
| 62-18988 | 2/1987 | Japan . |
| 4136890 | 12/1992 | Japan . |
| 1160509 | 8/1969 | United Kingdom . |

*Primary Examiner*—Khiem Nguyen

*Attorney, Agent, or Firm*—Sandler, Greenblum & Bernstein

[57] ABSTRACT

A terminal formed by bending from a single metal piece for use in a bulb socket having a bulb insertion opening for accommodating a bulb, where the terminal is used for connecting with a base electrode formed in the outer perimeter of the bulb includes a contact element. The contact element is formed by stamping the metal piece to have a contact portion and a spring portion for resiliently hold the contact portion in contact with the base electrode. The spring portion is located on a position away from the base electrode when the bulb is inserted in the bulb insertion opening. Therefore, the spring porion of the contact element is kept from deterioration of spring characteristics caused by the heat from the bulb.

3 Claims, 5 Drawing Sheets

TERMINAL

BACKGROUND OF THE INVENTION

1. Field of the Invention

The present invention relates to a terminal used in a bulb socket for use in automotive lights and, more particularly, to a terminal positioned inside the bulb socket and having a contacting element whose deterioration of the spring characteristics is prevented to improve the contact reliability to the negative terminal of the bulb base.

2. Description of the Prior Art

In FIGS. 9 and 10, a conventional socket-side negative terminal 1 for use in a bulb socket 2 formed by bending a single thin metal band is shown. The socket-side negative terminal 1 comprises a bulb-side connecting element 1*a* for electrically connecting with the bulb 3 formed flexibly stamped out at one end portion thereof, and a connector 1*b* for electrically connecting with the external connectors provided at the other end portion thereof.

As shown in FIG. 11, the terminal 1 is inserted to an insertion channel 2*c* with a T-shaped cross section formed in a perimeter wall 2*b* of a bulb insertion opening 2*a* of the socket 2. The tip of the connecting element 1*a* protruding to the inside from the insertion channel 2*c* contacts the negative terminal face of the bulb base 3*a* inserted to the bulb insertion opening 2*a*.

The connector 1*b* of the terminal 1 protrudes into the connector insertion opening 2*g* from the insertion hole formed in the bottom wall 2*f* of the bulb insertion opening 2*a*, and contacts the external connector (not shown).

A positive terminal 4 formed by bending a single metal piece is inserted to a positive terminal insertion channel 2*d*, which is formed diagonally to the negative terminal insertion channel 2*c* of the socket 2. A bulb-side connector 4*a* contacts the positive terminal of the bulb bottom 3*d*, and the other connector 4*d* protruding from the bottom wall 2*f* connects with the external connector.

A bulb 3 depicted by an imaginary line is secured in the socket 2 by inserting from the top a pair of pins 3*b*, which protrude at the outside circumference of the bulb base 3*a*, into J-shaped pin insertion channels 2*h* formed in the bulb insertion opening perimeter wall 2*b*, and then turning the bulb 3 after insertion to secure the bulb 3 in the socket 2.

As best shown in FIG. 9, the bulb-side connecting element 1*a* of this conventional negative terminal 1 is stamped out at the center near the end of the thin metal band lc to project at a specified angle $\theta p$ and extends by a predetermined length L*c* from the base 1*d* of the stamping and to flexibly contact the bulb base 3*a* with the contact 1*e* on the end of the projection.

When the negative terminal 1 shaped as described above is inserted to the socket 2 and contacts the bulb 3, the stamped base 1*d* of the connecting element 1*a* is positioned at the open end of the bulb insertion opening 2*a* approximately opposite the bulb base 3*a*, as best shown in FIG. 11.

When the bulb 3 is continuously turned on, the base 1*d* becomes hot because of the heat generated by the bulb 3. In particular, for example when a high output bulbs or double bulb are used for the bulb 3, the temperature at the base 1*d* sometimes reaches approximately 180° C.

When the base 1*d* of connecting element 1*a* gets hot, the spring characteristics thereof deteriorate so that the contact pressure of the contact 1*e* drops, and the contact resistance at the circumference of the bulb base 3*a* increases. This causes the already high temperature to rise further, resulting eventually in non-conductivity.

The deterioration of the spring characteristics of the base 1*d* will be described with reference to FIGS. 12A, 12B, and 12C. Since the connecting element 1*a* initially has sufficient spring, the connecting element 1*a* extrudes from the terminal 1 by a predetermined length To and positioned thereat, an original position inside the bulb insertion opening, as indicated by the imaginary line in FIG. 12A. When the bulb 3 is inserted in the bulb socket 2, the connecting element 1*a* is pressed by the bulb base 3 so that the connecting element 1*a* is moved from the original position to a contacting position at which the connecting 1*a* is resiliently contacted with the bulb base 3, as indicated by a solid line.

However, as the spring characteristics of the base 1*d* deteriorates, the connecting element 1*a* will eventually not return to the original position and stops at a deteriorated position below the terminal 1 by a length Td, as indicated by a imaginary line in FIG. 12B, even when the bulb 3 is removed from the socket 2. In this case, when other bulb 3 with a smaller base diameter is inserted into the socket 2, a gap Tg occurs between the outside circumference of the bulb base 3*a* and the contact 1*e*, as shown in FIG. 12C. Thus, the connecting element 1*a* can not contact with the bulb base 3*a*, resulting in the lack of conductivity between the terminal 1 and the bulb 3.

SUMMARY OF THE INVENTION

The object of the present invention is therefore to provide a terminal which solves these problems.

The present invention has been developed with a view to substantially solving the above described disadvantages and has for its essential object to provide an improved terminal.

In order to achieve the aforementioned objective, a terminal formed by a single metal piece for use in a bulb socket having a bulb insertion opening for accommodating a bulb, wherein said terminal makes an electric connection with a base electrode formed on outer perimeter of said bulb upon insertion of said bulb, said terminal comprises a flat plate portion; and a contact portion raised from said flat plate portion for contacting said base electrode, said contact portion integrally connected to said flat plate portion through a base portion, said base portion being located remote from said base electrode.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 2:
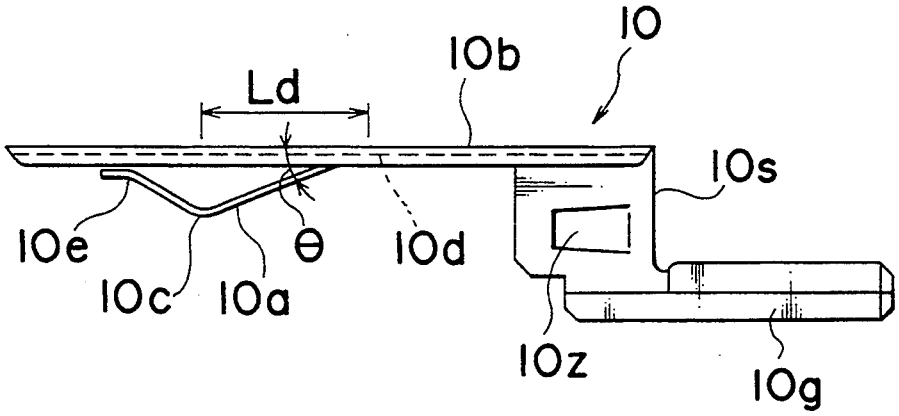
FIG. 2 is an enlarged side view showing the terminal of FIG. 1.
Figure 3:
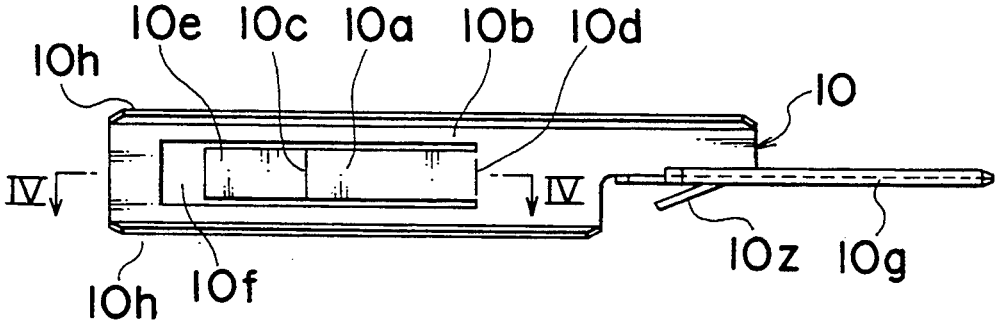
FIG. 3 is a plan view showing the terminal, viewed from the bottom side thereof, of FIG. 2.
Figure 4:
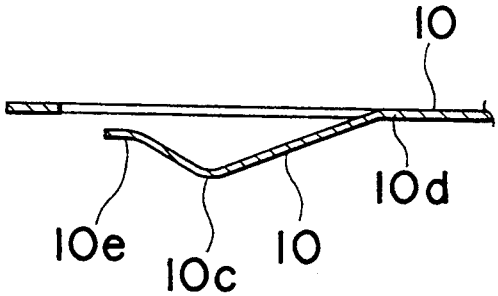
FIG. 4 is a fragmentary cross-sectional view showing a portion of the terminal taken along a line IV—IV in FIG. 3.

Referring to FIGS. 2, 3, and 4, a negative terminal used for the connection with a negative electrode of a bulb according to a first embodiment of the present invention is shown. The terminal 10 is formed in an elongated shape by bending a single metal piece. The terminal 10 includes a flat member 10*b* formed in an elongated thin band-shape extending in a direction, and a vertical support 10*s* formed at one end of the flat member 10*b* and extending perpendicularly therefrom. The terminal 10 further includes a connector member 10*g* formed at one end of the vertical support 10*s* opposed to the flat member 10*b*. The connector member 10*g* extends therefrom in such a direction that the connector member 10*g* is apart from the flat member 10*a*. Thus, the flat member 10*b* and connector member 10*g* are connected by the vertical support 10*s*. A stopper 10*z* is stamped out from the vertical support 10*s* to open to the direction opposed to the connector member 10*g*.

The flat member 10*b* has a contact element 10*a* cut in the middle portion thereof generally in a U-shaped configuration so that a base portion 10*d* by which the contact element 10*a* is integrally connected with the flat member 10*b* is formed on the side contiguous to the vertical support 10*z*. The contact element 10*a* is further stamped in generally a V-shaped configuration when viewed from the side, as best shown in FIG. 4, such that a stamped end 10*e* is positioned at the end portion of the flat member 10*b*. The contact member 10*a* projects at a specified angle 8 downward (toward the vertical support side) from the stamped base 10*d* and is bent upward (toward the flat member 10*b*) at a position distant from the base 10*g* by a predetermined length Ld. Thus, a contact portion 10*c* is formed at the valley portion of thus bent member 10*a*. Preferably, the tip of stamped end 10*e* is bent down to extend parallel to the flat member 10*b*. Since the contact element 10*a* is elastically stamped out, the base portion 10*d* provides spring effect to the contacting element 10*a* so that the contacting element 10 can swing elastically with respect to the base portion 10*d* against the external force.

Each of longitudinal sides of the flat member 10*b* is bent inside to provide a side rim 10*h* extending on both sides thereof.

Figure 1:
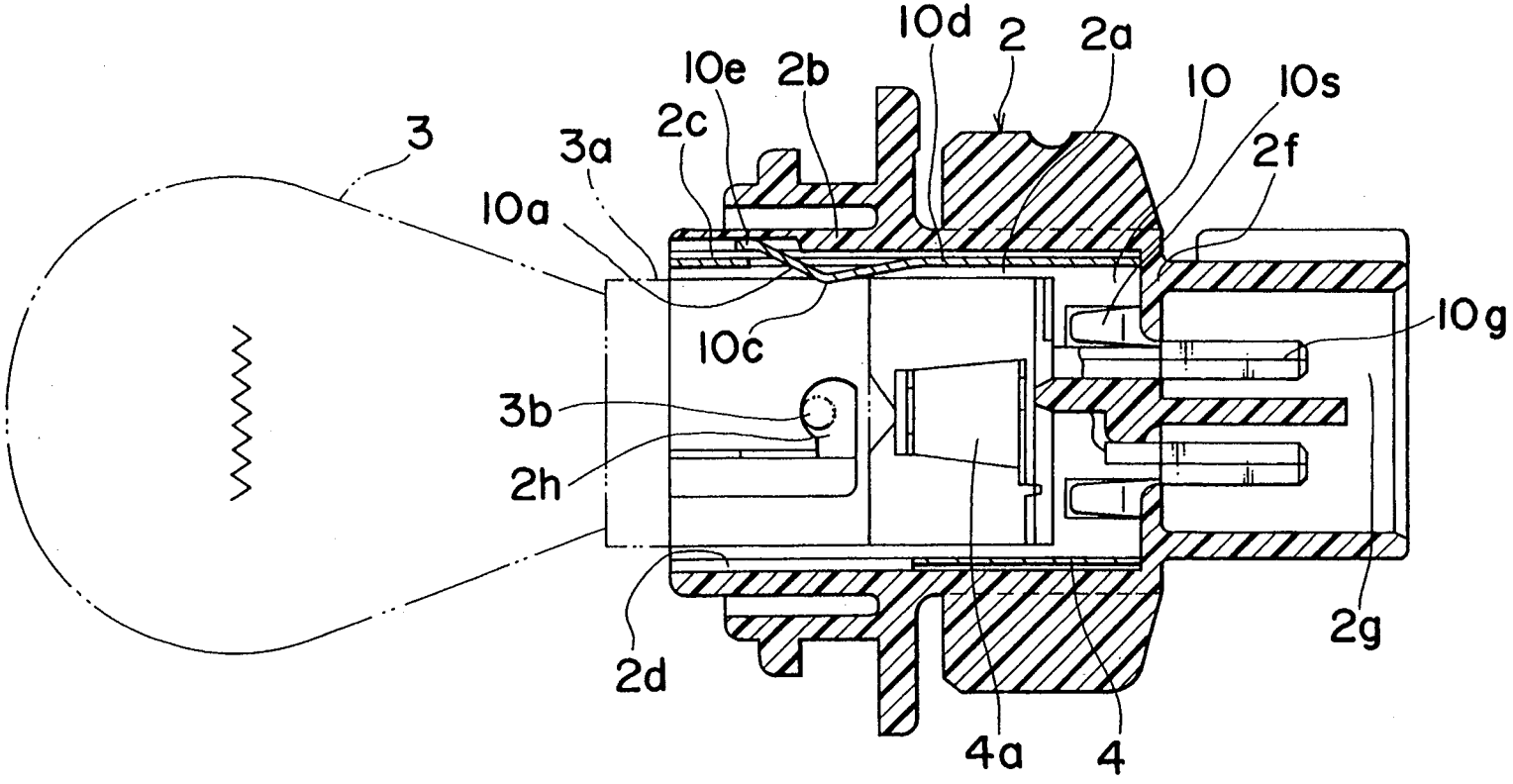
FIG. 1 is a cross-sectional view showing a bulb socket comprising a terminal according to a first embodiment of the present invention the invention.

Referring to FIG. 1, the terminal 10 used in a bulb socket 2 is shown. The terminal 10 is inserted to an insertion channel 2*c* with a T-shaped cross section formed in a perimeter wall 2*b* of a bulb insertion opening 2*a* of the socket 2. The tip 10*c* of the connecting element 10*a* protrudes to the inside from the insertion channel 2*c* and contacts the terminal face of a bulb base 3*a*. The base portion 10*d* is positioned at the bottom wall 2*f* side of the bulb insertion opening 2*a*, and the stamped end 10*e* is positioned at the open end side. And the stopper 10*z* is engaged with the socket 2 to prevent the terminal 10 from being removed. Then, the bulb 3 depicted by an imaginary line is inserted to the bulb insertion opening 2*a* from the bulb base 3*a*, the stamped base portion 10*d* is positioned at the open end of the bulb insertion opening 2*a* away from the bulb base 3*a*.

The connector member 10*g* of the terminal 10 protrudes into the connector insertion opening 2*g* from the insertion hole formed in the bottom wall 2*f* of the bulb insertion opening 2*a*, and contacts the external connectors (not shown) coming from the outside of the socket 2.

A positive terminal 4 used for the connection with a positive electrode of the bulb 3 is formed by bending a single metal piece, and is inserted to a positive terminal insertion channel 2*d*, which is formed diagonally to the negative terminal insertion channel 2*c* of the socket 2. A bulb-side connector 4*a* contacts the positive terminal of the bulb bottom 3*d*, and the other connector 4*d* protruding from the bottom wall 2*f* connects with the external connector.

The bulb 3 is secured in the socket 2 by inserting from the top a pair of pins 3*b*, which protrude at the outside circumference of the bulb base 3*a*, into J-shaped pin insertion channels 2*h* formed in the bulb insertion opening perimeter wall 2*b*, and then turning the bulb 3 after insertion to secure the bulb 3 in the socket 2.

In the first embodiment thus comprised, it is difficult for the base 10*d* to reach a high temperature, making it difficult for the spring characteristics to deteriorate, because the base 10*d* of the contact element 10*a* is separated away from the bulb base 3*a* of the heat-emitting bulb 3. Furthermore, the base 10*d* is positioned at a side contiguous to the connector member 10*g* through the vertical support member 10s. Since these members 10*g* and 10*s* are located in positions remote from the bulb base 3*a*, and are connected with heat/electrical conductive materials such as connectors and wires having lower temperature and greater heat capacity, the heat transmitted to the base 10*d* is scattered outside through these members. Thus, the base 10*d* can be kept within the temperature range in which the spring characteristics thereof will not deteriorates. Based on tests, the temperature at the base 10*d* is less than approximately 150° C., meaning that the improved cooling ability of more than 30° C. is obtained by the terminal 10 according to the present invention when compared with the conventional terminals.

Contact reliability of the negative terminal 10 is thus improved without inducing a drop in the contact pressure of the contact portion 10*c* because deterioration of the spring characteristics of the contact element 10*a* is difficult according to the present invention.

It is to be noted that the stamped end 10e of the contact element 10a is positioned at the insertion side of the bulb base 3a, but insertion of the bulb base 3a can be done smoothly because the stamped end 10e is folded back opposite to the stamped direction.

Figure 9:
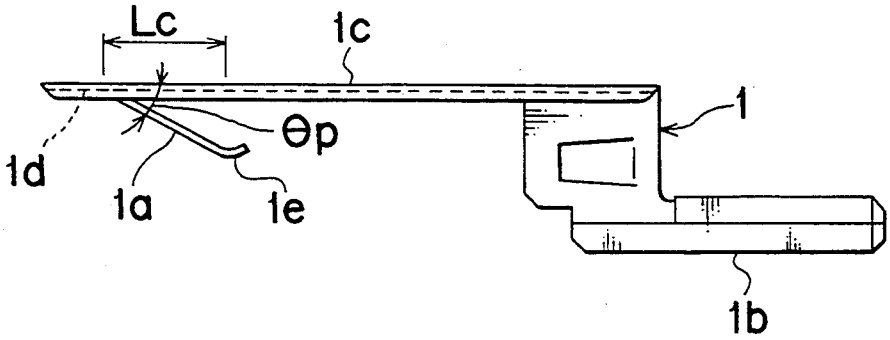
Fig. 9 PRIOR ART
FIG. 9 is a side view showing a conventional terminal for use in a bulb socket.
Figure 10:
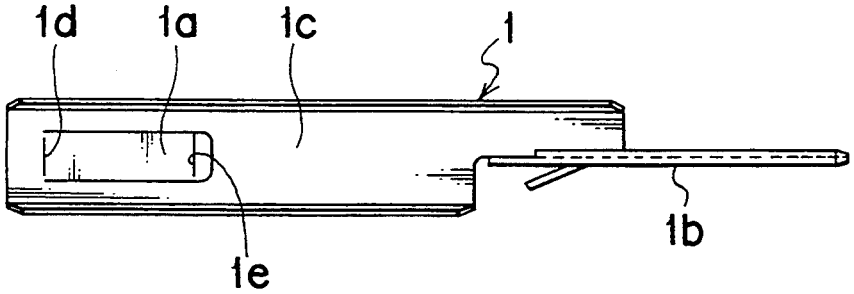
Fig. 10 PRIOR ART
FIG. 10 is a plan view showing the terminal, viewed from the bottom side thereof, of FIG. 9.
Figure 11:
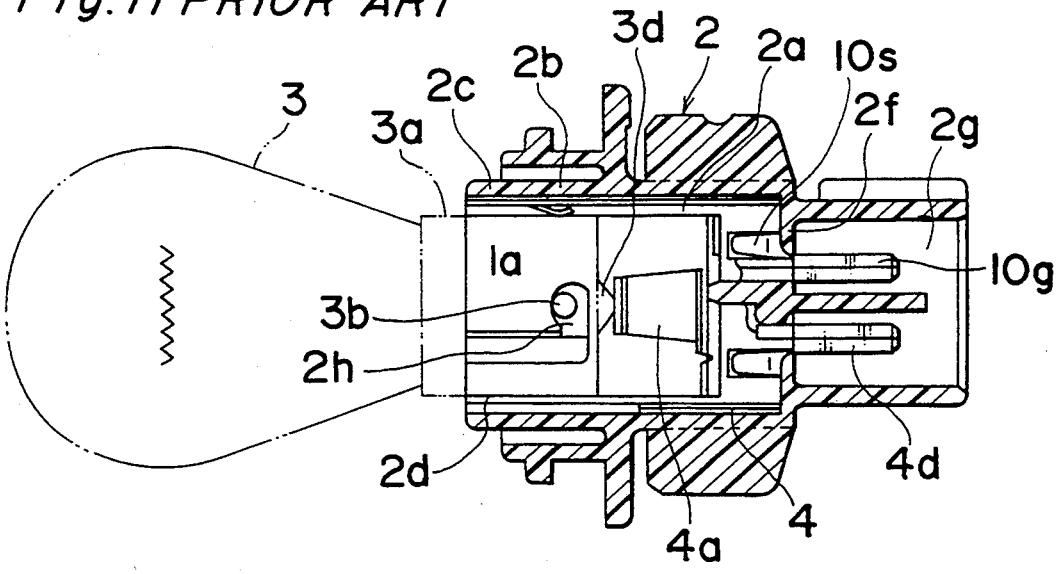
Fig. 11 PRIOR ART
FIG. 11 is a cross-sectional view showing a bulb socket comprising the conventional terminal of FIG. 9, and FIGS. 12A, 12B, and 12C are fragmentary side views in assistance of explaining the deterioration state of the conventional terminal of FIG. 9.
Figure 12A:
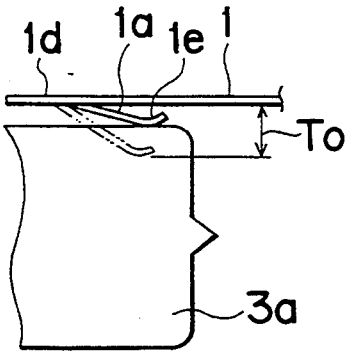
Fig. 12A PRIOR ART
Figure 12B:
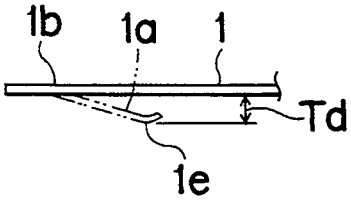
Fig. 12B PRIOR ART
Figure 12C:
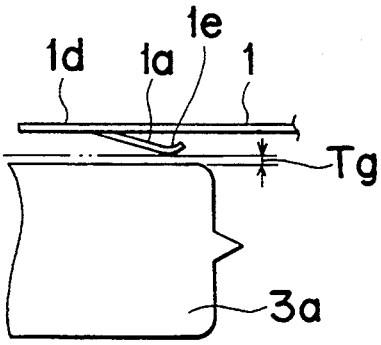
Fig. 12C PRIOR ART

In the first embodiment, the length Ld between the base 10d and the contact 10c can be set longer than the conventional length Lc (see FIG. 9), and the lift angle $\theta$ of the base 10d can be less than the lift angle $\theta p$ of the conventional terminal (FIG. 9) because the base 10d of the contact element 10a is provided on the side of the bottom wall 2f of the bulb insertion opening 2a in the socket 2. As a result, the stress acting on the base 10d is reduced, there is no concentration of excessive stress, and deterioration of the spring characteristics is inhibited. In the first embodiment, the contact reliability of the negative terminal 10 can also be improved because of this.

Figure 5:
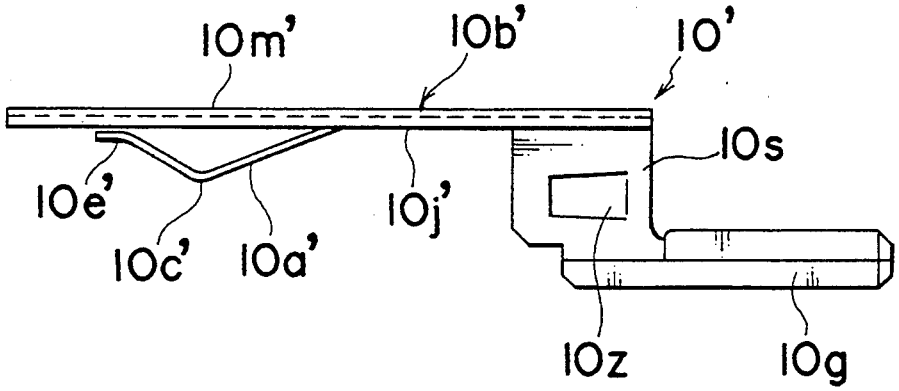
FIG. 5 is a cross-sectional view showing a terminal according to a second embodiment of the present invention, a side view of a negative terminal according to the second embodiment of the invention.
Figure 6A:
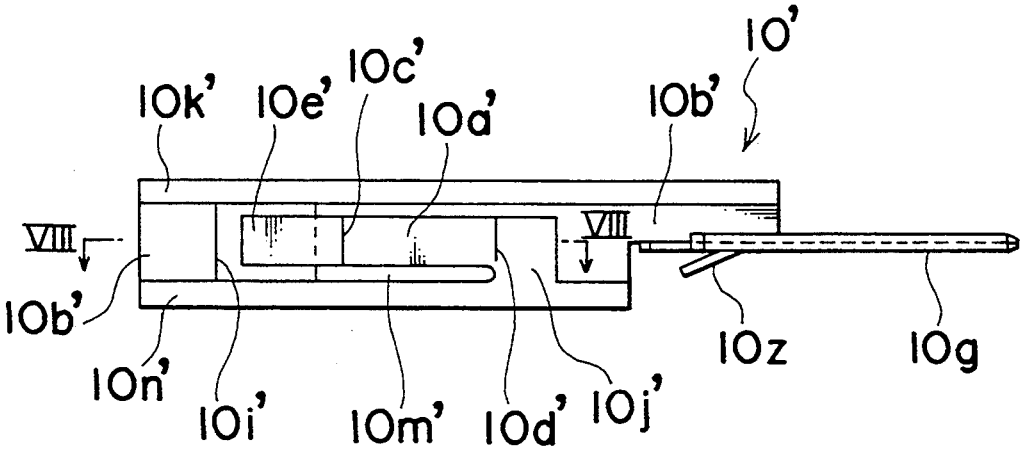
FIG. 6A is a plan view showing the terminal, viewed from the bottom side thereof, of FIG. 5.

Referring to FIGS. 5, 6A, 6B, 7, and 8, a terminal according to a second embodiment of the present invention is shown. The terminal 10' has the construction similar to that of the terminal 10 according to the first embodiment, as shown in FIGS. 5 and 6A.

Figure 6B:
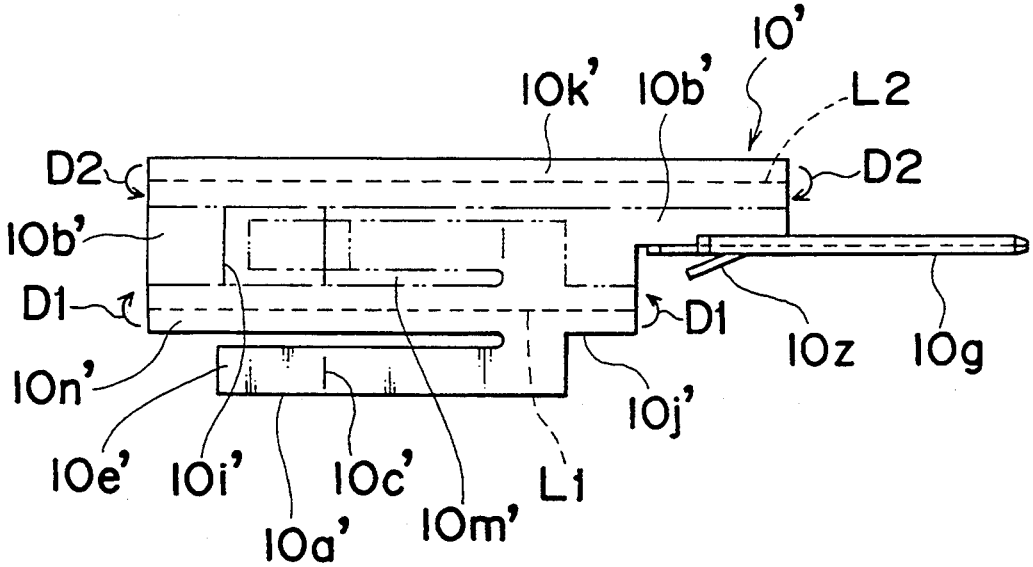
FIG. 6B is a plan view showing the terminal at a partially developed state, of FIG. 6A.
Figure 7:
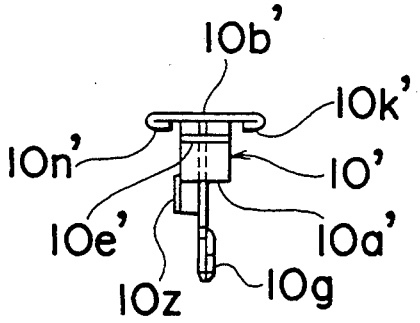
FIG. 7 is a front view showing the terminal, viewed from the left side, of FIG. 5.
Figure 8:
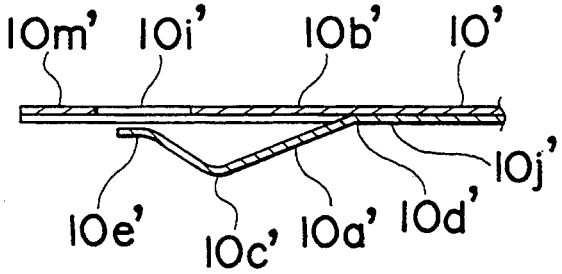
FIG. 8 is a fragmentary cross-sectional view showing a portion of the terminal taken along a line VIII—VIII in FIG. 6A.

In FIG. 6B, a developed state of a flat member 10b' of the terminal 10' before bending is shown. The negative terminal 10' has a first side members 10j' on the one of elongated sides, and a second side member 10k' on the other elongated side. The first side member 10j' is folded inside in the arrow direction D1 with respect to a first side line L1 indicated by a dot line to overlap with the center portion 10m' of the flat member 10b'. Also, the second side member 10k' is folded inside in the arrow direction D2 with respect to a second side line L2 indicated by a dot line. Thus, the terminal 10' can be completed, as shown in FIG. 6A.

In this terminal 10', the contact element 10a' is formed at the outside edge of the first side members 10j'. The contact element 10a' is positioned at the midpoint of the center portion 10m', and an inside edge 10n' of the first side member 10j' is doubled along the first side line L1, forming a first side edge of the center portion 10m'.

The second side member 10k' is folded double along the second side line L2, forming a second side edge of the center portion 10m'. As a result, both outside edge members of the center portion 10m' are completely doubled.

At the center of the center portion 10m' overlapping the contact element 10a', a small clearance hole 10i' for passing the stamped end 10e' when the contact element 10a' is in contact with the bulb base 3 is formed at a position opposing to the stamped end 10e'. The remainder other than the clearance hole 10i' reinforces the other parts of the contact element 10a', specifically backing the base 10d' of the contact 10c'.

In this second embodiment, both sides of the flat member 10b' on which the contact element 10a' is provided are completely doubled, the center portion 10m' is positioned behind the projecting part of the contact element 10a', and the open space from forming the contact element 10a' is reduced, making it possible to improve the strength.

In addition, because it is sufficient to provide the clearance hole 10i' formed in the center portion 10m' to oppose to the stamped end 10e', the clearance hole 10' can be made small. The overall area of the flat member 10b' can thus be increased, increasing the heat dissipation area much, and improving the heat dissipation characteristics because the area of the center portion 10m' can be increased and both side members 10j' and 10k' are folded back.

Furthermore, since the terminal 10' has the contact element 10a' which is additionally provided thereto, as shown in FIGS. 6A and 6B, the terminal 10' has the heat capacity greater than that of the terminal 10 according to the first embodiment. Therefore, it is more difficult to elevate the temperature of the base 10d' of the terminal 10' when compared with the terminal 10.

As will be obvious from the above description, the bases 10d and 10d' do not easily reach a high temperature because the base 10d and 10d' are provided on the bottom wall side, remote from the bulb base 3a, of the insertion end of the bulb insertion opening of the bulb socket 2. Good spring characteristics can thus be maintained, and contact reliability can be improved, because the bases 10d and 10d' are not exposed to high temperatures and deterioration of the spring characteristics can be prevented.

Furthermore, since the bases 10d and 10d' are located on a side contiguous to the connector element 10g which will be connected with heat/electrical conductive materials such as connectors and wires having lower temperature and greater heat capacity, the bases 10d and 10d' can be kept in a lower temperature range in which the deterioration of spring characteristics thereof can be prevented.

In addition, stress acting on the contact elements 10a and 10a' are low, excessive stress is not concentrated on the bases 10d and 10d', deterioration of the spring characteristics is prevented, and contact reliability can also be improved accordingly because the length Ld between the base portion 10d (10d') and the contact 10c (10c') can be long, and the lift angle $\theta$ of the base can be low.

In addition, strength is improved, the heat dissipation area is increased, and heat dissipation characteristics can be improved because the flat member is reinforced by the folded side members and the hole for stamping is eliminated in the flat member when both sides of the flat member of the negative terminal are folded in two and the connector is provided at one of the folded sides.

Although the present invention has been fully described in connection with the preferred embodiments with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A terminal formed by a single piece for use in a bulb socket having a bulb insertion opening for accommodating a bulb, said bulb having a sealed envelope containing a filament, wherein said terminal makes an electric connection with a base electrode surrounding an outer perimeter of a base portion of said sealed envelope upon insertion of said bulb, said base electrode being electrically connected to said filament, said insertion opening having a first location for accommodating said base electrode and a second location spaced from said first location, said terminal comprising:

a flat plate portion; and a contact portion raised from said flat plate portion for contacting said base electrode, said contact portion integrally connected to said flat plate portion through a base portion, said base portion being located at said second location in said insertion opening remote from said base electrode.

2. A terminal formed by a single metal piece for use in a bulb socket having a bulb insertion opening for accommodating a bulb, said bulb having a sealed envelope containing a filament, wherein said terminal makes an electric connection with a base electrode surrounding an outer perimeter of said bulb upon insertion of said bulb, said base electrode being electrically connected to said filament, said insertion opening having a first location for accommodating said base electrode and a second location spaced from said first location, said terminal comprising:

a flat portion formed by two folded layers of said single metal piece;

a contact portion raised from one of said two folded layers for contacting said base electrode, said contact portion integrally connected to said flat plate portion through a base portion, said base portion being located at said second location in said insertion opening remote from said base electrode.

3. A terminal as claimed in claim 1, further comprising a connector means for electrically connecting said flat plate portion with an external terminal, said connector means extending from on one end of said terminal adjacent said base portion so as to scatter heat at said base portion through said connector means.

* * * * *